US011180902B2

(12) United States Patent
Christofferson et al.

(10) Patent No.: US 11,180,902 B2
(45) Date of Patent: Nov. 23, 2021

(54) FORWARD LOOKING SENSOR FOR PREDICTIVE GRADE CONTROL

(71) Applicant: DEERE & COMPANY, Moline, IL (US)

(72) Inventors: Craig Christofferson, Dubuque, IA (US); Michael D. Peat, Dubuque, IA (US); John M. Hageman, Dubuque, IA (US); Tarik Loukili, Johnston, IA (US)

(73) Assignee: DEERE & COMPANY, Moline, IL (US)

( * ) Notice: Subject to any disclaimer, the term of this patent is extended or adjusted under 35 U.S.C. 154(b) by 534 days.

(21) Appl. No.: 16/058,021

(22) Filed: Aug. 8, 2018

(65) Prior Publication Data

US 2020/0048869 A1 Feb. 13, 2020

(51) Int. Cl.

| | |
|---|---|
| ***E02F 9/26*** | (2006.01) |
| ***E02F 3/84*** | (2006.01) |
| ***E02F 3/76*** | (2006.01) |

(52) U.S. Cl.

CPC ..... *E02F 9/262* (2013.01); *E02F 3/7677* (2013.01); *E02F 3/844* (2013.01); *E02F 9/264* (2013.01)

(58) Field of Classification Search

CPC . E02F 9/262; E02F 9/264; E02F 9/265; E02F 3/7677; E02F 3/844; E02F 3/84; E02F 3/845

See application file for complete search history.

(56) References Cited

U.S. PATENT DOCUMENTS

| | | | | |
|---|---|---|---|---|
| 3,487,884 A * | 1/1970 | Volberding | ..... | E02F 3/7618 172/817 |
| 3,899,028 A * | 8/1975 | Morris | ..... | E02F 3/845 172/4.5 |
| RE28,979 E * | 9/1976 | Long | ..... | E02F 3/845 172/4.5 |

(Continued)

FOREIGN PATENT DOCUMENTS

| | | |
|---|---|---|
| DE | 112013001746 T5 | 2/2015 |
| WO | 2017163823 A1 | 9/2017 |

(Continued)

OTHER PUBLICATIONS

German Search Report issued in counterpart application No. 102019211708.2 dated Jun. 29, 2020 (10 pages).

*Primary Examiner* — Jamie L McGowan
(74) *Attorney, Agent, or Firm* — Taft Stettinius & Hollister LLP; Stephen F. Rost

(57) ABSTRACT

A vehicle grade control system and method of controlling an implement position of a motor grader moving along a path of a surface. The motor grader includes a frame supported by wheels and an implement adjustably coupled to the frame. The control system includes a processor and a memory configured to receive a grade target to grade the surface to a desired grade with the implement based on the grade target. Surface irregularities of the surface in a path of the motor grader are located. An angle of the frame is determined based on the located surface irregularities and a difference between the identified angle of the frame and the grade target is determined. A position of the implement with respect to the frame based on the determined difference is identified and the surface is graded with the identified position of the implement.

20 Claims, 5 Drawing Sheets

(56) References Cited

U.S. PATENT DOCUMENTS

| | | | | |
|---|---|---|---|---|
| 5,327,345 | A * | 7/1994 | Nielsen | E01C 19/006 172/4.5 |
| 10,066,367 | B1 * | 9/2018 | Wang | E02F 9/2029 |
| 10,120,388 | B2 * | 11/2018 | Sakai | G05D 1/024 |
| 10,248,133 | B2 * | 4/2019 | Stratton | E02F 9/2054 |
| 10,316,491 | B2 * | 6/2019 | Gentle | E02F 9/262 |
| 10,508,412 | B2 * | 12/2019 | Hashimoto | E02F 9/262 |
| 10,526,766 | B2 * | 1/2020 | Hageman | E02F 3/845 |
| 10,563,374 | B2 * | 2/2020 | Hashimoto | E02F 9/262 |
| 10,604,912 | B2 * | 3/2020 | Hashimoto | G05D 1/0274 |
| 2011/0035109 | A1 * | 2/2011 | Ryerson | E02F 9/225 701/42 |
| 2012/0204537 | A1 * | 8/2012 | Dea | F01N 9/002 60/273 |
| 2013/0255977 | A1 * | 10/2013 | Braunstein | E02F 3/765 172/4.5 |
| 2016/0300175 | A1 * | 10/2016 | Talmaki | G06Q 10/06315 |
| 2016/0334804 | A1 | 11/2016 | Webber et al. | |
| 2017/0226717 | A1 | 8/2017 | Cherney | |
| 2018/0163376 | A1 | 6/2018 | Redenbo et al. | |
| 2019/0024340 | A1 | 1/2019 | Ono | |
| 2019/0078292 | A1 | 3/2019 | Ono | |
| 2019/0093313 | A1 * | 3/2019 | Ono | G01C 7/04 |
| 2020/0173141 | A1 * | 6/2020 | Gentle | E02F 3/815 |

FOREIGN PATENT DOCUMENTS

| | | | |
|---|---|---|---|
| WO | 2017164053 | A1 | 9/2017 |
| WO | WO2017163768 | A1 | 9/2017 |

* cited by examiner

FORWARD LOOKING SENSOR FOR PREDICTIVE GRADE CONTROL

FIELD OF THE DISCLOSURE

The present disclosure relates to a work vehicle, such as a motor grader, for grading a surface, and in particular to a vehicle grade control system for controlling an implement position based on a forward looking sensor to achieve a desired grade of the surface.

BACKGROUND

Work vehicles, such as a motor grader, can be used in construction and maintenance for creating a flat surface at various angles, slopes, and elevations. When paving a road for instance, a motor grader can be used to prepare a base foundation to create a wide flat surface to support a layer of asphalt. A motor grader can include two or more axles, with an engine and cab disposed above the axles at the rear end of the vehicle and another axle disposed at the front end of the vehicle. An implement, such as a blade, is attached to the vehicle between the front axle and rear axle.

Motor graders include a drawbar assembly attached toward the front of the grader, which is pulled by the grader as it moves forward. The drawbar assembly rotatably supports a circle drive member at a free end of the drawbar assembly and the circle drive member supports a work implement such as the blade, also known as a mold board. The angle of the work implement beneath the drawbar assembly can be adjusted by the rotation of the circle drive member relative to the drawbar assembly.

In addition, to the blade being rotated about a rotational fixed axis, the blade is also adjustable to a selected angle with respect to the circle drive member. This angle is known as blade slope. The elevation of the blade is also adjustable.

To properly grade a surface, the motor grader includes a one or more sensors which measure the orientation of the vehicle with respect to gravity and the location of the blade with respect to the vehicle. A rotation sensor located at the circle drive member provides a rotational angle of the blade with respect to a longitudinal axis defined by a length of the vehicle. A blade slope sensor provides a slope angle of the blade with respect to a lateral axis which is generally aligned with a vehicle lateral axis, such as defined by the vehicle axles. A mainfall sensor provides an angle of travel of the vehicle with respect to gravity.

Machine control systems, which include 2 dimensional (2D) and 3 dimensional (3D) machine control systems, are located at the surface being graded to provide grade information to the motor grader. A vehicle grade control system receives signals from the machine control system to enable the motor grader to grade the surface. The motor grader includes a grade control system operatively coupled to each of the sensors, so that the surface being graded can be graded to the desired slope, angle, and elevation. The desired grade of the surface is planned ahead of or during a grading operation.

Machine control systems can provide slope, angle, and elevation signals to the vehicle grade control system to enable the motor grader or an operator to adjust the slope, angle, and elevation of the blade. The vehicle grade control system can be configured to automatically control the slope, angle, and elevation of the blade to grade the surface based on desired slopes, angles, and elevations as is known by those skilled in the art. In these automatic systems, adjustments to the position of the blade with respect to the vehicle are made constantly to the blade in order to achieve the slope, angle and/or elevation targets. Many vehicle grade control systems offer an included or optional display that indicates to the operator how well the vehicle grade control system is keeping up to the target slope, angle, and/or elevation.

In some conditions, the surface being graded includes gullies, ravines, ditches, or other depressions that are recessed below a grade surface and ridges, mounds, banks, or other elevated areas that extend above a grade surface. Each of the depressions or elevated areas are irregularly shaped and can extend across a surface at varying angles with respect to the moving direction of the vehicle. As the vehicle moves over these irregularities, the blade of a motor grader deviates from the desired grade surface which prevents the vehicle from operating efficiently and effectively when reshaping the grade of the surface.

Therefore, a need exists for adjusting the position of the blade in response to the occurrence of the irregularities to grade a surface to a grade target.

SUMMARY

In one embodiment of the present disclosure, there is provided a method of controlling an implement position of a vehicle moving along a path of a surface. The vehicle includes a frame supported by wheels and an implement adjustably coupled to the frame. The method includes: receiving a grade target to grade the surface to a desired grade with the implement; locating surface irregularities of the surface in a path of the motor grader; identifying an angle of the frame based on the located surface irregularities, determining a difference between the identified angle of the frame and the grade target; identifying a position of the implement with respect to the frame based on the determined difference; and grading the surface with the identified position of the implement.

In another embodiment of the present disclosure, there is provided a vehicle grade control system for a vehicle having wheels, a frame, and an implement configured to move through a range of positions with respect to the frame to grade a surface having a current grade to a grade target. The control system includes an antenna operatively connected to the frame and configured to receive a location of the vehicle with respect to the surface. One or more image sensors is configured to image surface irregularities of the surface in a path of the vehicle and to transmit one or more images of the surface irregularities. Control circuitry is operatively connected to the antenna and to the one or more image sensors. The control circuitry includes a processer and a memory, wherein the memory is configured to store program instructions and the processor is configured to execute the stored program instructions to: locate surface irregularities from the one or more imaged surface irregularities; identify an anticipated angle of the frame based on the located surface irregularities; determine a difference between the identified anticipated angle of the frame and the grade target; identify a position of the implement with respect to the frame based on the determined difference; and adjust the position of the implement with based on the identified position to grade the surface to arrive at the grade target.

In still another embodiment of the present disclosure, there is provided a method of controlling an implement position of a plurality of motor graders configured to move along a path of a surface, wherein each of the motor graders includes a frame supported by wheels and an implement adjustably coupled to the frame. The method includes:

receiving, at a first motor grader of one of the plurality of motor graders, a grade target to grade the surface to a desired grade with the implement; locating surface irregularities of the surface in a path of the first motor grader; identifying an anticipated angle of the frame of the first motor grader based on the located surface irregularities; determining a difference between the identified angle of the frame of the first motor grader and the grade target; identifying positions of the implement of the first motor grader with respect to the frame based on the determined difference during the first path; grading the surface of the path with the identified position of the implement of the first motor grader; and identifying the path graded by the first motor grader.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
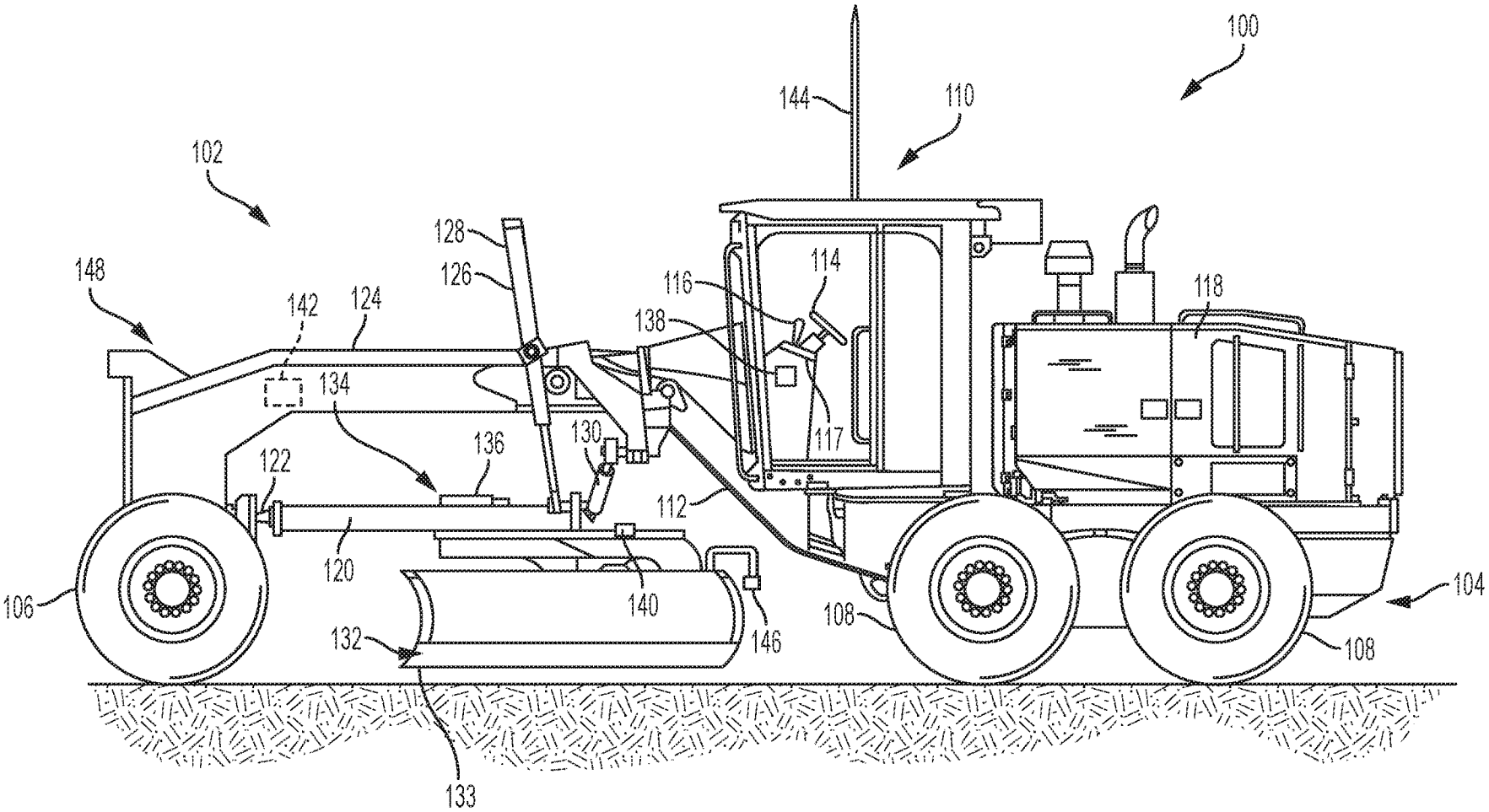
FIG. 1 is a side view of a motor grader.

Referring to FIG. 1, an exemplary embodiment of a vehicle, such as a motor grader 100, is shown. An example of a motor grader is the 772G Motor Grader manufactured and sold by Deere & Company. While the present disclosure discusses a motor grader, other types of work machines are contemplated including graders, road graders, dozers, bulldozers, crawlers, and front loaders.

As shown in FIG. 1, the motor grader 100 includes front frame 102 and rear frame 104, with the front frame 102 being supported on a pair of front wheels 106, and with the rear frame 104 being supported on right and left tandem sets of rear wheels 108. A straight line extending between the wheel centers generally defines a wheel axis transverse to a longitudinal plane of the vehicle 100 and generally parallel to wheel treads in contact with the surface being graded. In one or more embodiments, the front frame 102 and rear frame 104 are fixedly coupled together. In still other embodiment, the front frame 102 and rear frame 104 are moveable with respect to one another such that the front frame 102 and rear frame 104 articulate with respect to one another. Articulation of the vehicle during a grading operation is also known as "crabbing".

An operator cab 110 is mounted on an upwardly and inclined rear region 112 of the front frame 102 and contains various controls for the motor grader 100 disposed so as to be within the reach of a seated or standing operator. In one aspect, these controls may include a steering wheel 114 and a lever assembly 116. A user interface 117 is supported by a console located in the cab and includes one or more different types of operator controls including manual and electronic buttons of switches. In different embodiments, the user interface 117 includes a visual display providing operator selectable menus for controlling various features of the vehicle 100. In one or more embodiments, a video display is provided to show images provided by the image sensor 148 or cameras located on the vehicle.

An engine 118 is mounted on the rear frame 104 and supplies power for all driven components of the motor grader 100. The engine 118, for example, is configured to drive a transmission (not shown), which is coupled to drive the rear wheels 108 at various selected speeds and either in forward or reverse modes. A hydrostatic front wheel assist transmission (not shown), in different embodiments, is selectively engaged to power the front wheels 106, in a manner known in the art.

Mounted to a front location of the front frame 102 is a drawbar or draft frame 120, having a forward end universally connected to the front frame 102 by a ball and socket arrangement 122 and having opposite right and left rear regions suspended from an elevated central section 124 of the front frame 102. Right and left lift linkage arrangements including right and left extensible and retractable hydraulic actuators 126 and 128, respectively, support the left and right regions of the drawbar 120. The right and left lift linkage arrangements 126 and 128 either raise or lower the drawbar 120. A side shift linkage arrangement is coupled between the elevated frame section 124 and a rear location of the drawbar 120 and includes an extensible and retractable side swing hydraulic actuator 130. A blade or mold board 132 is coupled to the front frame 102 and powered by a circle drive assembly 134. The blade 132 includes an edge 133 configured to cut, separate, or move material. While a blade 132 is described herein, other types of implements are contemplated.

The drawbar 120 is raised or lowered by the right and left lift linkage arrangements 126 and 128 which in turn raises or lowers the blade 132 with respect to the surface. The actuator 130 raises or lowers one end of the blade 132 to adjust the slope of the blade.

The circle drive assembly 134 includes a rotation sensor 136, which in different embodiments, includes one or more switches that detect movement, speed, or position of the blade 132 with respect to the vehicle front frame 102. The rotation sensor 136 is electrically coupled to a controller 138, which in one embodiment is located in the cab 110. In other embodiments, the controller 138 is located in the front frame 102, the rear frame 104, or within an engine compartment housing the engine 118. In still other embodiments, the controller 138 is a distributed controller having separate individual controllers distributed at different locations on the vehicle. In addition, while the controller is generally hardwired by electrical wiring or cabling to sensors and other related components, in other embodiments the controller includes a wireless transmitter and/or receiver to communicate with a controlled or sensing component or device which either provides information to the controller or transmits controller information to controlled devices.

A blade slope/position sensor 140 is configured to detect the slope and/or position of the blade 132 and to provide slope and/or position information to the controller 138. In different embodiments, the blade slope/position sensor 140 is coupled to a support frame for the blade 132 of the hydraulic actuator 130 to provide the slope information. A mainfall sensor 142 is configured to detect the grading angle of the vehicle 100 with respect to gravity and to provide grading angle information to the controller 138. The mainfall sensor 142 is configured to measure one or more of angles of slope, tilt, elevation, or depression with respect to gravity. In one embodiment, the mainfall sensor 142 includes an inertial measurement unit (IMU) configured to determine a roll position and a pitch position with respect to gravity. In other embodiments, the mainfall sensor includes other inclination measuring devices for measuring an angle of the vehicle, such as an inclinometer. The mainfall sensor 142 provides a signal including roll and pitch information of the straightline axis between wheel centers and consequently roll and pitch information of the vehicle 100. The roll and pitch information is used by the ECU 150 to adjust the position of the blade 132.

In other embodiments, the vehicle 100 includes angle sensors at both the front frame 102 and the rear frame 104 to determine the position of the front frame 102 with respect to the rear frame 104 during articulation. In these embodiments, grade control is achieved using one or more of implement position, front frame position, and rear frame position.

An antenna 144 is located at a top portion of the cab 110 and is configured to receive signals from different types of machine control systems including sonic systems, laser systems, and global positioning systems (GPS). While the antenna 144 is illustrated, other locations of the antenna 144 are included as is known by those skilled in the art. For instance, when the vehicle 100 is using a sonic system, a sonic tracker 146 is used detect reflected sound waves transmitted by the sonic system through with the sonic tracker 146. In a vehicle 100 using a laser system, a mast (not shown) located on the blade supports a laser tracker located at a distance above the blade 132. In one embodiment, the mast includes a length to support a laser tracker at a height similar to the height of a roof of the cab. A GPS system includes a GPS tracker located on a mast similar to that provided for the laser tracker system. Consequently, the present disclosure applies vehicle motor grader systems using both relatively "simple" 2D cross slope systems and to "high end" 3D grade control systems.

In additional embodiments, the grade control system includes devices, apparatus, or systems configured to determine the mainfall of the vehicle, as well as devices, apparatus, or systems configured to determine the slope and/or the position of the blade. For instance, blade position is determined by one or more sensors. In one embodiment, an inertial measurement unit to determine blade position is used. Consequently, other systems to determine mainfall and blade slope/position are contemplated.

A ground image sensor 148 is fixedly mounted to the front frame 102 at a location generally unobstructed by any part of the vehicle 100. The ground image sensor 148 includes one or more of a transmitter, receiver, or a transceiver directed to the ground in front of and being approached by the vehicle 100. In different embodiments, the ground image sensor 148 includes one or more of a two dimensional camera, a radar device, and a laser scanning device, and a light detection and ranging (LIDAR) scanner. The ground image sensor 148 is configured to provide an image of the ground being approached which is transmitted to an electronic control unit (ECU) 150 of FIG. 2. In different embodiments, the ground image sensor 148 is one of a grayscale sensor, a color sensor, or a combination thereof.

Figure 2:
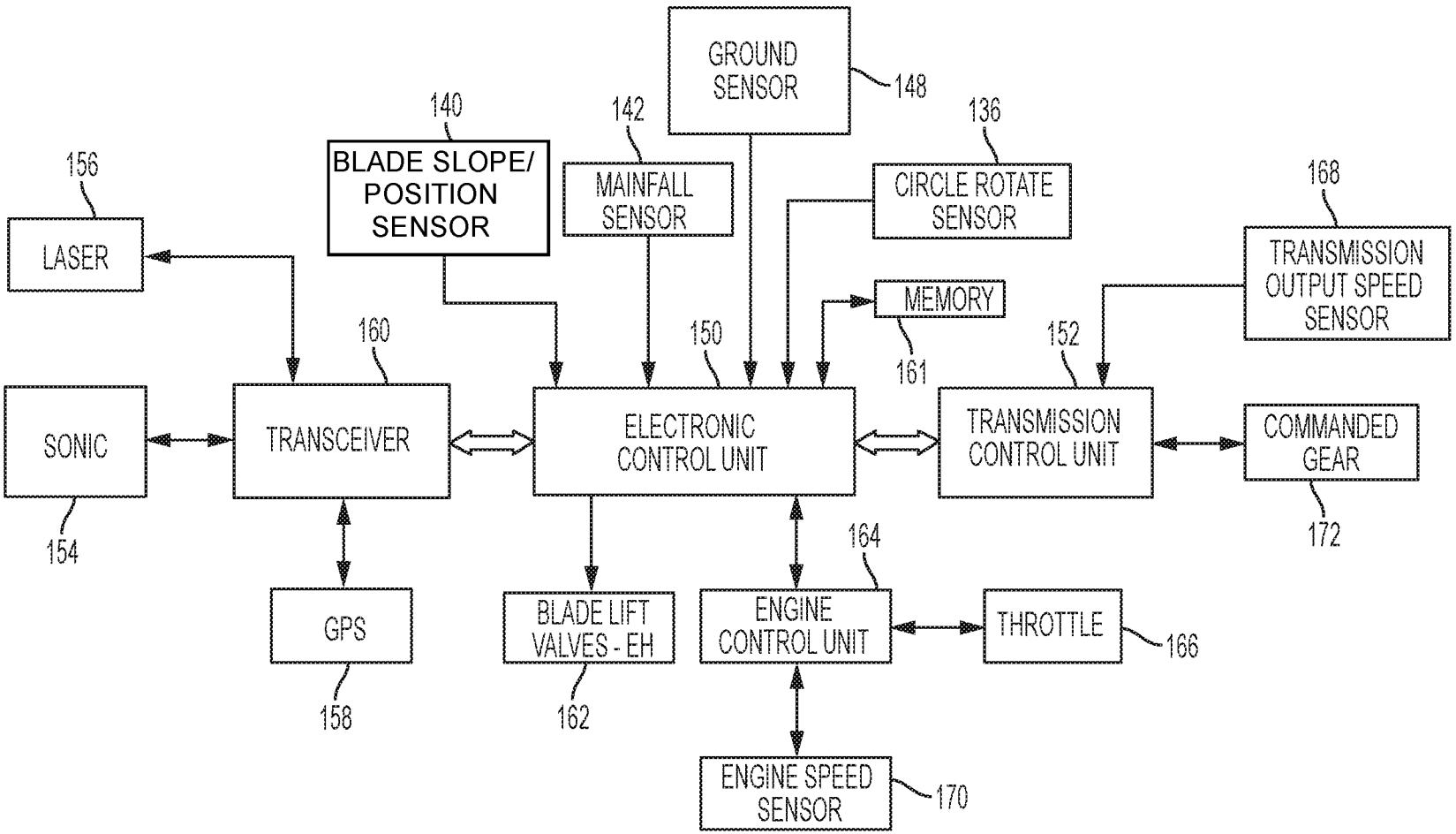
FIG. 2 is a simplified schematic diagram of a vehicle and a vehicle grade control system of the present disclosure.

FIG. 2 is a simplified schematic diagram of the vehicle 100 and a vehicle grade control system embodying the invention. In this embodiment, the controller 138 is configured as the ECU 150 operatively connected to a transmission control unit 152. The ECU 150 is located in the cab 110 of vehicle 100 and the transmission control unit 152 is located at the transmission of the vehicle 100. The ECU 150 receives slope, angle, and/or elevation signals generated by one or more types of machine control systems including a sonic system 154, a laser system 156, and a GPS system 158. Other machine control systems are contemplated. These signals are collectively identified as contour signals. Each of the machine control systems 154, 156, and 158 communicates with the ECU 150 through a transceiver 160 which is operatively connected to the appropriate type of antenna as is understood by those skilled in the art.

Figure 3:
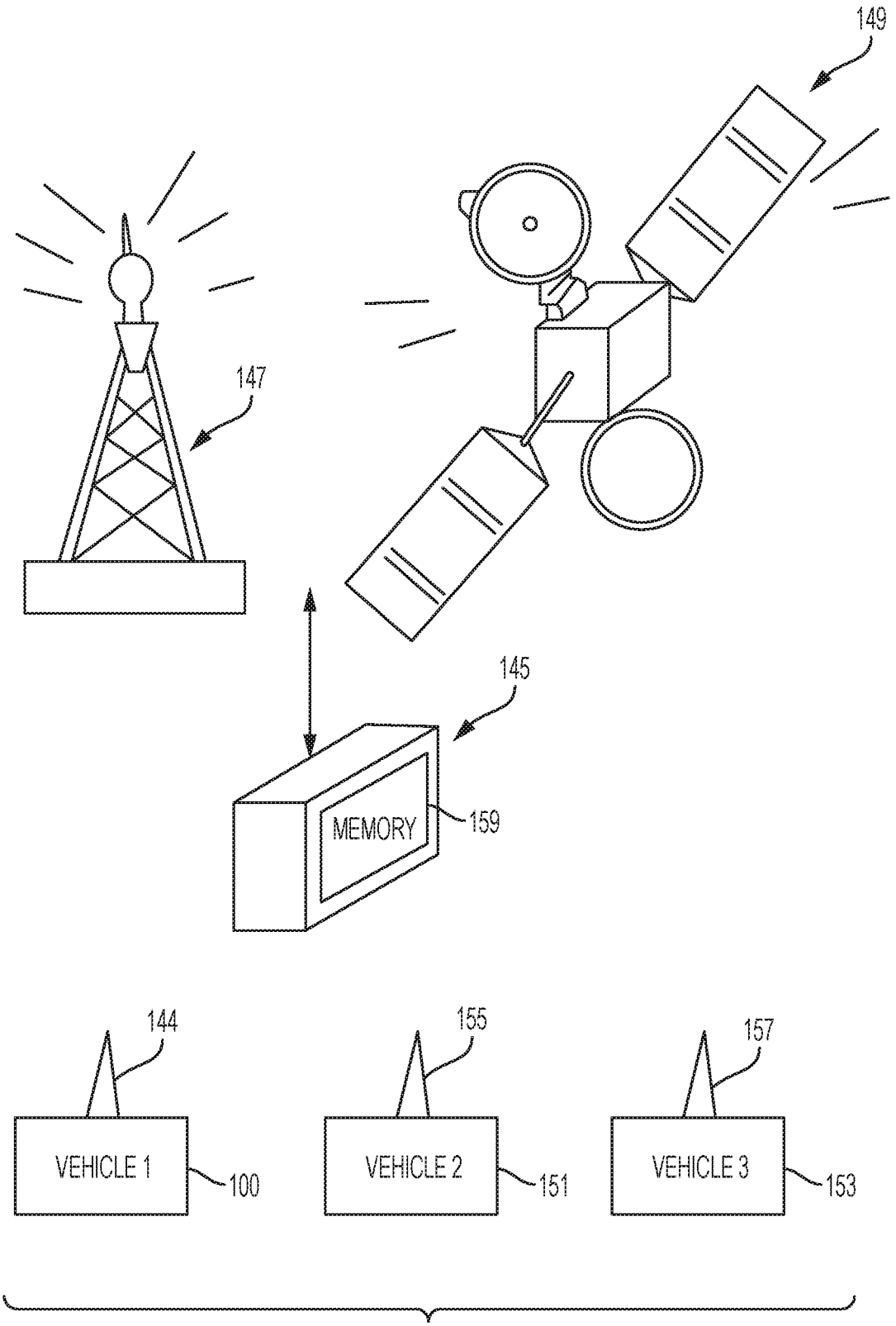
FIG. 3 is a schematic diagram of a plurality of vehicles configured to grade a surface and to communicate with a server.

As illustrated in FIG. 3, the antenna 144 is further configured, in one or more embodiments, to communicate with a server 145 through a communication tower 147 or a satellite 149. Other types of communication devices are contemplated. The server 145 is disposed at a location distant from the vehicle 100, such that the vehicle communicates wirelessly with the server through one or both of the communication tower 147 or the satellite 149 to facilitate wireless communication between the vehicle 100 and the server 145. Wireless communication is facilitated, in different embodiments, by a microwave tower, a 3G or 4G tower, or radios. Other means of wireless communication are contemplated.

In different embodiments, the server 145 is located at a facility maintained by the manufacturer of the vehicle, a manufacturer of the ECU 150, or a server facility maintained by a third party where the facility includes a plurality of servers serving unassociated users, often called "cloud" computing facilities. The antenna 144 is shown in FIG. 3 as being associated with vehicle 100 identified as vehicle 1. One or more additional vehicles, including a vehicle 151 and a vehicle 153 each respectively include antennas 155 and 157 configured to receive and to transmit data through the antenna 147 or satellite 149 to the server 145. The server 145 includes a memory 159 for the storage of such data. Each of vehicles 151 and 153 includes a vehicle grade control system such as that illustrated in FIG. 2.

In different embodiments, the data stored in the memory 159 includes mapping data provided by the locations and directions traveled by each of the vehicles 100, 151, and 153. The mapping data is based on paths graded by the vehicle. In some embodiments, positions of the implement made by the implement when grading along the path are included in the mapping data. This data is processed by the ECU 150 to configure a map, which is accessible by each of the vehicles for use vehicle's control system to improve productivity. In one embodiment, the mapping data is transmitted in real time as the vehicle traverses the path. In other embodiments, the mapping data is stored in the server memory 159, which is accessible by one or more of the vehicles 100, 151, and 153 by known wireless techniques. In still other embodiments, the mapping data is stored locally in one or more of the vehicles and subsequently transmitted to the server memory or directly to one or more of the other vehicles.

The map information is used in conjunction with grade information by the vehicle's ECU 150 to determine one or more paths for the vehicle or vehicles when grading the surface. The ECU 150 of the vehicle selected to make a second or later pass along a path previously traveled determines a preferred path to be taken by the vehicle. In one embodiment, blade height information, blade angle, or both, are stored during a first path is compared to the preferred final contour of the surface being graded and used to determine a second preferred path. In one or more embodiments, two or more vehicles operate simultaneously along different parts of the terrain being graded to optimize productivity.

The ECU 150, in different embodiments, includes a computer, computer system, or other programmable devices. In other embodiments, the ECU 150 can include one or more processors (e.g. microprocessors), and an associated memory 161, which can be internal to the processor of external to the processor. The memory 161 can include random access memory (RAM) devices comprising the memory storage of the ECU 150, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to ECU 150. The mass storage device can include a cache or other dataspace which can include databases. Memory storage, in other embodiments, is located in the "cloud", where the memory is located at a distant location which provides the stored information wirelessly to the ECU 150.

The ECU 150 executes or otherwise relies upon computer software applications, components, programs, objects, modules, or data structures, etc. Software routines resident in the included memory of the ECU 150 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices which execute the instructions which are resident in memory, which are responsive to other instructions generated by the system, or which are provided a user interface operated by the user. The ECU 150 is configured to execute the stored program instructions.

The ECU 150 is also operatively connected to a blade lift valves assembly 162 (see FIG. 2) which is in turn operatively connected to the right and left lift linkage arrangements 126 and 128 and the actuator 130. The blade lift valves assembly 162, in one embodiment, is an electrohydraulic (EH) assembly which is configured to raise or lower the blade 132 with respect to the surface or ground and to one end of the blade to adjust the slope of the blade. In different embodiments, the valve assembly 162 is a distributed assembly having different valves to control different positional features of the blade. For instance, one or more valves adjust one or both of the linkage arrangements 126 and 128 in response to commands generated by and transmitted to the valves and generated by the ECU 150. Another one or more valves, in different embodiments, adjusts the actuator 130 in response to commands transmitted to the valves and generated by the ECU 150. The ECU 150 responds to grade status information, provided by the sonic system 154, the laser system 156, and the GPS 158, and adjusts the location of the blade 132 through control of the blade lift valves assembly 162. The location of the blade is adjusted based on the current position of the blade with respect to the vehicle, speed of blade if being manipulated, and the direction of the blade.

To achieve better productivity and to reduce operator error, the ECU 150 is coupled to the transmission control unit 152 to control the amount of power applied to the wheels of the vehicle 100. The ECU 150 is further operatively connected to an engine control unit 164 which is, in part, configured to control the engine speed of the engine 116. A throttle 166 is operatively connected to the engine control unit 164. In one embodiment, the throttle 166 is a manually operated throttle located in the cab 110 which is adjusted by the operator of vehicle 100. In another embodiment, the throttle 166 is additionally a machine controlled throttle which is automatically controlled by the ECU 150 in response to grade information and vehicle speed information.

The ECU 150 provides engine control instructions to the engine control unit 164 and transmission control instruction to the transmission control unit 152 to adjust the speed of the vehicle in response to grade information provided by one of the machine control systems including the sonic system 154, the laser system 156, and the GPS system 158. In other embodiments, other machine control systems are used. Vehicle direction information is determined by the ECU 150 in response to direction information provided by the steering device 114.

Vehicle speed information is provided to the ECU 150, in part, by the transmission control unit 152 which is operatively connected to a transmission output speed sensor 168. The transmission output speed sensor 168 provides a sensed speed of an output shaft of the transmission, as is known by those skilled in the art. Additional transmission speed sensors are used in other embodiments including an input transmission speed sensor which provides speed information of the transmission input shaft.

Additional vehicle speed information is provided to the ECU 150 by the engine control unit 164. The engine control unit 164 is operatively connected to an engine speed sensor 170 which provides engine speed information to the engine control unit 164.

A current vehicle speed is determined at the ECU 150 using speed information provided by one of or both of the transmission control unit 152 and the engine control unit 164. The speed of the vehicle 100 is increased by speed control commands provided by the ECU 150 when the grade control system is on target to ensure maximum productivity.

Figure 4:
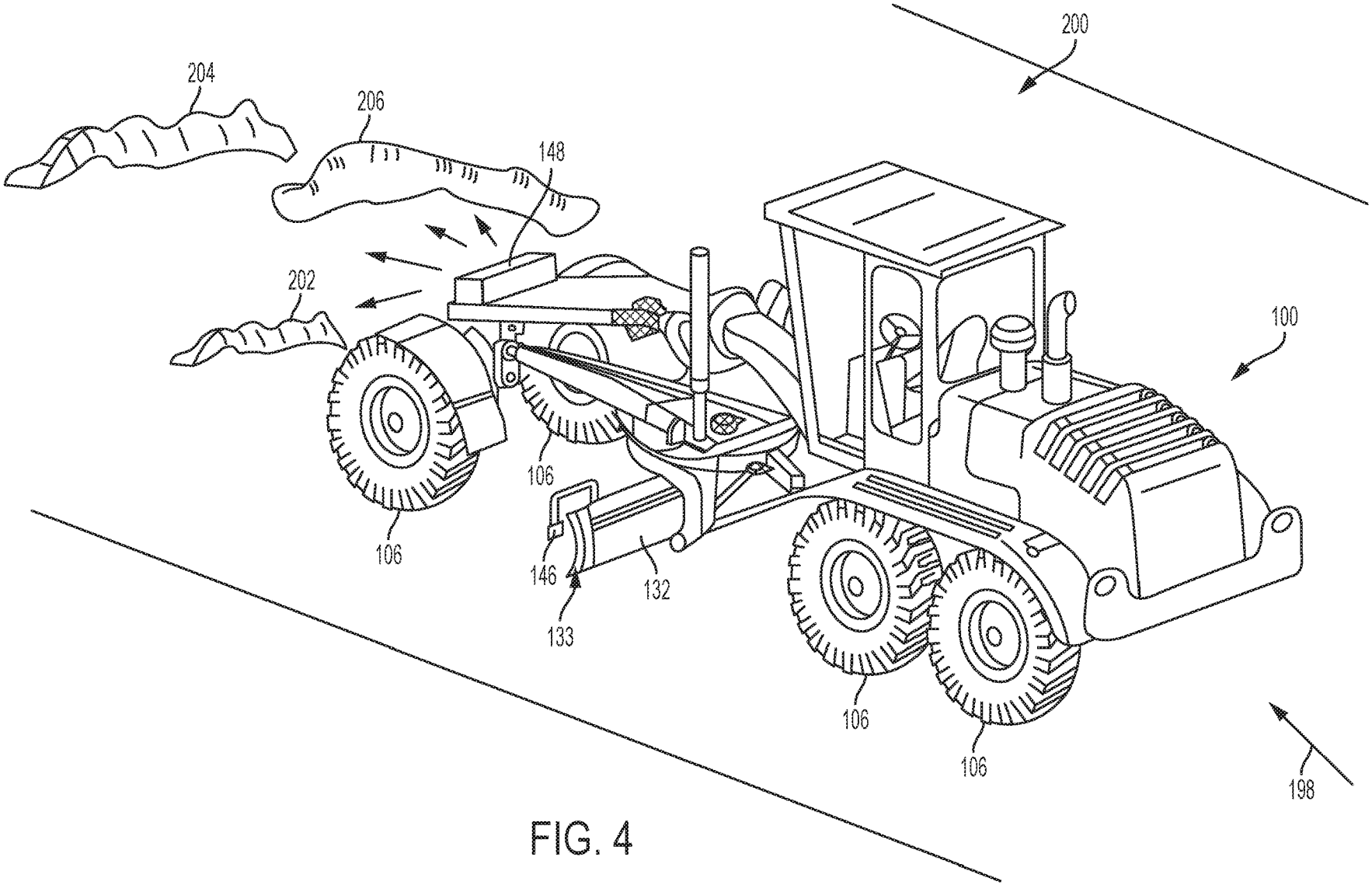
FIG. 4 is a depiction of a motor grader grading a surface having irregularities.

FIG. 4 illustrates the vehicle 100 moving along a path 198 of a surface 200 being graded. In this example, a final grade, the target grade, of surface 200 is predetermined and surface irregularities 202, 204, and 206 are located above or below the final grade. As the vehicle moves along the path, the ground image sensor 148 provides images of the surface 200 located in front of the vehicle 100. During this forward movement, the surface 200 (including the irregularities), is imaged by the ground image sensor 148 and the images are transmitted to the ECU 150. A field of view of the ground image sensor 148 includes a width, in at least one embodiment, sufficient to provide a view of upcoming irregularities 202, 204, and 206 for instance. Irregularities 202 and 204 are generally elevated above the surface 200 and the irregularity 206 is below the surface. For the purposes of this disclosure, the irregularities are deviations from the desired grade. Irregularities located below the desired grade are considered to be negative irregularities and irregularities above the desired grade are considered to be positive irregularities. In addition, the irregularities encountered by one of the front wheels 106 and the other of the front wheels 106, in different embodiments are both above the target grade, both below the target grade, or one is above and one is below the target grade.

As the vehicle moves along the path 198, the wheels 106 encounter portions of different irregularities at the same time, and consequently the wheels 106 are at different heights with respect to the intended grade of the surface 200. These different wheel heights correspondingly affect the location of the edge 133 of the blade 132 with respect to the intended surface 200.

The edge 133 is therefore inclined with respect to the ground surface by two factors that change as the vehicle 100 moves along the path 198. The first factor is based on the angle of the vehicle with respect to gravity as determined by the mainfall sensor 142. The second factor is based on the angle of the blade 132 with respect to the longitudinal axis of the vehicle 100. The blade angle with respect to the vehicle includes a first angle with respect to the horizontal axis defined by the wheel axis and a second angle defined with respect to the longitudinal axis of the vehicle, which is generally the same as the direction of the path 198, which is known as the cross-slope angle.

Figure 5:
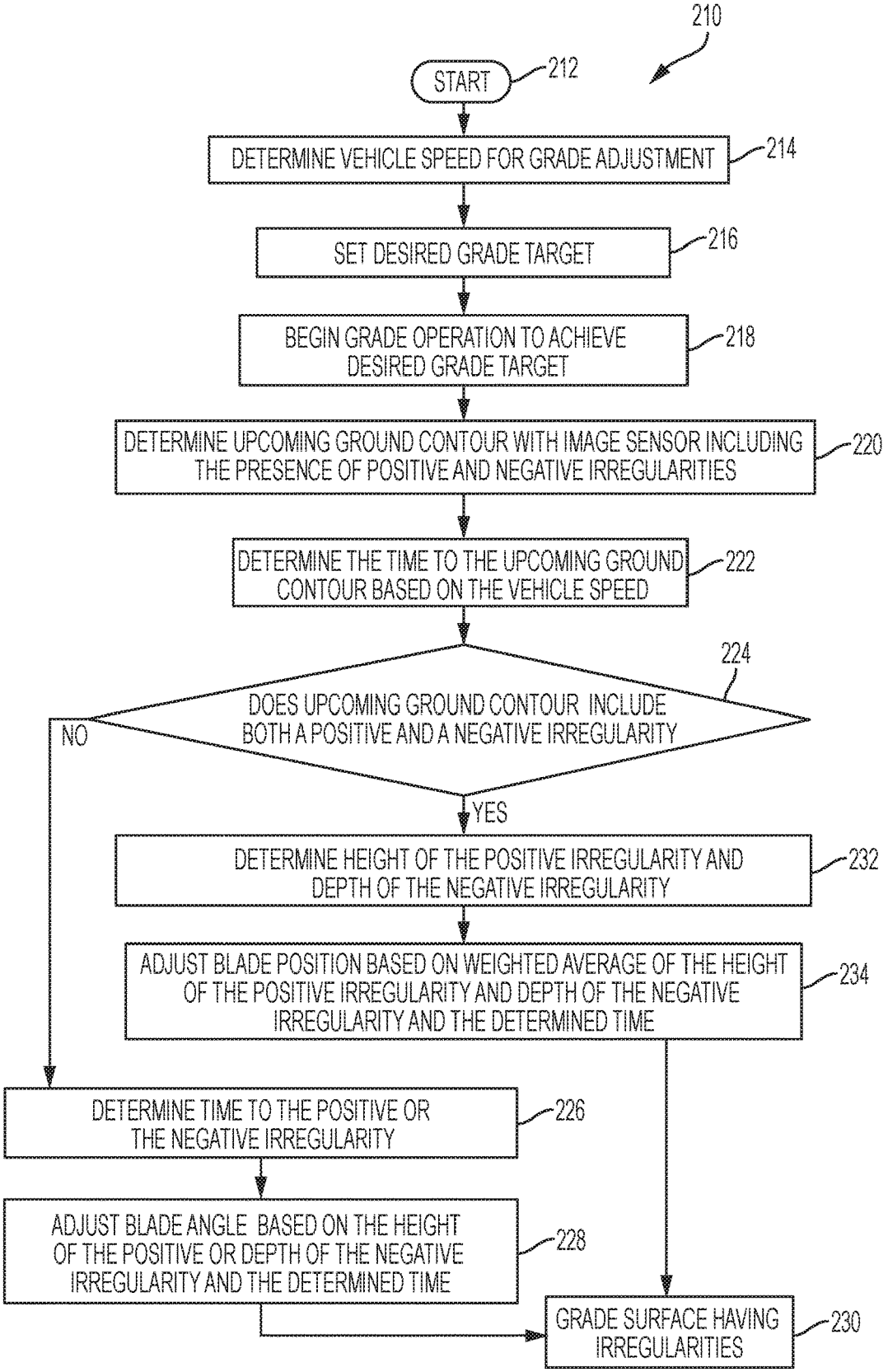
FIG. 5 is a flow diagram of a method to adjust a position of an implement of a motor grader.

FIG. 5 illustrates a flow diagram of a process 210 to adjust the position of the blade 132 based on the condition of the surface being graded. Initially, the process 210 includes a start procedure 212 which begins based on an operator input or a vehicle input. For instance, in different embodiments the operator begins a grading process by providing an input to the user interface 117, such as speed of the vehicle. In other embodiments, the GPS 158 or other surface determining system provides a suggested speed of travel for the vehicle 100 based on the contour of the surface to be graded. The vehicle speed is input to the ECU 150 by the operator or by electronic means provided by the grade determination system. The vehicle speed for adjustment of the grade is determined at block 214. The desired grade target set at block 216 and transmitted to the ECU 150. Once the vehicle speed and the desired grade target have been provided, the vehicle begins a grade operation at the desire grade target at block 218.

As the vehicle 100 moves along the path 198, the sensor 148 generates image data which is transmitted to the ECU 150. The ECU 150 is configured to process the received image data to determine the location and size of any positive or negative irregularity including length, height, depth, and distance to the irregularity. The ECU 150 determines the upcoming or anticipated ground contour with the image sensor 148 that can include both positive and negative irregularities. The memory 161 includes, in one or more embodiments, an object detector and an edge detector. The object detector and edge detector are each software applications or program code which are used by the processor ECU 150 to determine the content of the images transmitted by the image sensor 148 at block 220. The object detector is configured to determine the location of objects, positive and negative irregularities, found in the images and the edge detector is configured to determine the relationship between the objects found in the images. Distance of the vehicle 100, and particularly the blade 132 to the irregularities is also determined. Object detection software and edge detector software that determine the features appearing in the images are known by those skilled in the art.

Using one or more of the identified objects, edges, and distances, the time to arrive at the anticipated ground contour, which may include irregularities, is determined by the ECU 150 at block 222. This determined time of arrival is used to by the ECU 150 to adjust the position of the blade 132 at the appropriate time.

In different embodiments, the ECU 150 includes an object detector configured to distinguish the properties of different types of surface materials which are used to adjust the position of the blade 132. In one example, the object detector is configured to determine different types of aggregate materials including but not limited to sand, pebbles, packed soil, gravel, and others. The object detector determines the type of material and adjusts blade position to accommodate for the determined type of material.

The ECU 150 is further configured to determine, based on the received image content, whether the upcoming ground contour both a positive and a negative irregularity at block 224. If it does not, the ECU 150 determines the time to the positive or negative irregularity at block 226. Once the time has been determined the ECU 150 adjusts the blade angle based on a height of the positive irregularity or a depth of the negative ground irregularity using the determined time to arrival at the irregularity at block 228. After adjustment, the surface having the irregularity is adjusted at block 230.

If the upcoming surface includes both a positive and a negative ground irregularity, the height of the positive ground irregularity and the depth of the negative ground irregularity is determined at block 232. Once determined, the ECU 150 adjusts the blade position based on a weighted average of the height of the positive ground irregularity and the depth of the negative ground irregularity and the determined time at block 234. After adjustment, the surface is graded at block 230.

At block 234, the process takes into account the likelihood that the front tires 106 encounter both a positive irregularity and a negative irregularity at the same time. Because one wheel is elevated and the other wheel is lowered with respect to a final grade target, the ECU 150 accounts for the difference in heights which affects the poisoning of the blade. For instance, if only the positive irregularity is used to make a determination of blade position, the negative irregularity may not receive any material to fill in the depression. Consequently, the weighted average is used to reduce the number of times the vehicle passes over the same surface area to achieve a final grade needed to meet the desired grade target.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A method of controlling an implement position of a vehicle moving along a path of a surface, the vehicle having a frame supported by wheels and an implement adjustably coupled to the frame, the method comprising:

receiving a grade target to grade the surface to a desired grade with the implement;

locating surface irregularities of the surface in a first path of the motor grader;

identifying an angle of the frame based on the located surface irregularities, determining a difference between the identified angle of the frame and the grade target;

identifying a position of the implement with respect to the frame based on the determined difference; and grading the surface with the identified position of the implement;

storing mapping data based on the locations and directions traveled during the first path of the motor grader in a memory operatively connected to a motor grader controller;

comparing the stored mapping data to the grade target to determine a second path of the motor grader; and grading the surface along the second path.

2. The method of claim 1 further comprising determining one or both of blade height information or blade angle information.

3. The method of claim 2 wherein the storing mapping data includes storing mapping data based on one or both of the blade height information or the blade angle information.

4. The method of claim 3 wherein the storing mapping data includes storing mapping data in a memory of a server disposed at a location distant from the motor grader.

5. The method of claim 4 further comprising transmitting the stored mapping data from the server memory to the motor grader.

6. The method of claim 4 further comprising transmitting the stored mapping date from the server memory to a different motor grader.

7. The method of claim 3 wherein the identifying an angle of the frame is based on a location of the wheels with respect to the current grade, wherein a first front wheel is located at a first position with respect to the desired grade and a second front wheel is located at a second position with respect to the desired grade.

8. The method of claim 7 wherein the locating surface irregularities includes locating both a positive irregularity and a negative irregularity, wherein the positive irregularity is in the path of the first front wheel and the negative irregularity is in the path of the second front wheel.

9. The method of claim 7 wherein the identifying a position of the implement includes determining one or more of a height of the first front wheel with respect to the grade target, determining a height of the second front wheel with respect to the grade target, determining a height of a first rear wheel with respect to the grade target, and determining a height of a second rear wheel with respect to the grade target.

10. The method of claim 9 wherein the identifying a position of the implement with respect to the frame includes moving a first end of the implement a first vertical distance with respect to the frame and moving a second end of the implement a second vertical distance with respect to the frame, the first vertical distance based on the first irregularity and the second vertical distance based on the second irregularity.

11. The method of claim 10 wherein the identifying an angle of the frame includes identifying the angle based on a roll or pitch of the frame and the identifying an angle of the frame includes identifying the inclination with one of an inertial measurement unit or an inclinometer.

12. The method of controlling an implement position of a vehicle moving along a path of a surface, the vehicle having a frame supported by wheels and an implement adjustably coupled to the frame, the method comprising:

receiving a grade target to grade the surface to a desired grade with the implement;

locating surface irregularities of the surface in a path of the motor grader;

identifying an angle of the frame based on the located surface irregularities, determining a difference between the identified angle of the frame and the grade target;

identifying a position of the implement with respect to the frame based on the determined difference;

grading the surface with the identified position of the implement;

wherein the identifying an angle of the frame is based on a location of the wheels with respect to the current grade, wherein a first front wheel is located at a first position with respect to the desired grade and a second front wheel is located at a second position with respect to the desired grade; and wherein the locating surface irregularities includes locating both a positive irregularity and a negative irregularity, wherein the positive irregularity is in the path of the first front wheel and the negative irregularity is in the path of the second front wheel.

13. The method of claim 12 wherein the identifying an angle of the frame includes identifying the angle based on a roll or pitch of the frame.

14. The method of claim 13 wherein the identifying an angle of the frame includes identifying the inclination with one of an inertial measurement unit or an inclinometer.

15. The method of claim 12 wherein the identifying an angle of the frame includes identifying the angle based on a roll or pitch of the frame.

16. The method of claim 12 wherein the identifying a position of the implement includes determining one or more of a height of the first front wheel with respect to the grade target, determining a height of the second front wheel with respect to the grade target, determining a height of a first rear wheel with respect to the grade target, and determining a height of a second rear wheel with respect to the grade target.

17. The method of claim 16 wherein the identifying a position of the implement with respect to the frame includes moving a first end of the implement a first vertical distance with respect to the frame and moving a second end of the implement a second vertical distance with respect to the frame, the first vertical distance based on the first irregularity and the second vertical distance based on the second irregularity.

18. A method of controlling an implement position of a plurality of motor graders each configured to move along a path of a surface, each of the motor graders including a frame supported by wheels and an implement adjustably coupled to the frame, the method comprising:

receiving, at a first motor grader of one of the plurality of motor graders, a grade target to grade the surface to a desired grade with the implement;

locating surface irregularities of the surface in a path of the first motor grader;

identifying an anticipated angle of the frame of the first motor grader based on the located surface irregularities;

determining a difference between the identified angle of the frame of the first motor grader and the grade target;

identifying positions of the implement of the first motor grader with respect to the frame based on the determined difference during the first path;

grading the surface of the path with the identified position of the implement of the first motor grader;

identifying the path graded by the first motor grader;

storing mapping data based on the locations and directions traveled during the path of the first motor grader in a memory;

transmitting to a second motor grader of the plurality of motor graders the stored mapping data; and grading the surface of the path with the second motor grader based on the transmitted mapping data.

19. The method of claim 18 further comprising:

grading the surface with the second motor grader based on the transmitted mapping data.

20. The method of claim 18 further comprising:

wherein the storing mapping data of the first motor grader includes storing mapping data in a server memory disposed at a location distant from the first motor grader;

transmitting the stored mapping data of the first motor grader from the server memory to the second motor grader; and grading the surface based on the the transmitted mapping data.

* * * * *